US011081813B2

(12) United States Patent
Ito

(10) Patent No.: US 11,081,813 B2
(45) Date of Patent: Aug. 3, 2021

(54) CONNECTOR COMPRISING A TRMINAL FITTING HAVING INTERSECTING EXTENSION PORTIONS

(71) Applicant: Yazaki Corporation, Tokyo (JP)

(72) Inventor: Naoki Ito, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/901,254

(22) Filed: Jun. 15, 2020

(65) Prior Publication Data

US 2021/0021059 A1 Jan. 21, 2021

(30) Foreign Application Priority Data

Jul. 19, 2019 (JP) ..... JP2019-133312

(51) Int. Cl.
*H01R 4/28* (2006.01)
*H01R 13/639* (2006.01)

(52) U.S. Cl.
CPC ..... *H01R 4/28* (2013.01); *H01R 13/639* (2013.01)

(58) Field of Classification Search
CPC ..... H01R 4/28; H01R 4/629
USPC ..... 439/304, 352, 345, 346, 362, 364, 619, 439/660, 678, 699.1, 708, 723, 290, 439/607.01, 850, 852
See application file for complete search history.

(56) References Cited

U.S. PATENT DOCUMENTS 5,211,589 A * 5/1993 McCardell ..... H01R 13/4364 439/176
5,685,746 A * 11/1997 Maejima ..... H01R 13/11 439/845
6,102,752 A * 8/2000 Bommel ..... H01R 13/18 439/845
7,241,190 B2 * 7/2007 Smyk ..... H01R 13/187 439/852
7,485,016 B2 * 2/2009 Ishigami ..... H01R 4/184 439/748
7,976,351 B2 * 7/2011 Boemmel ..... H01R 13/432 439/748
9,972,932 B2 * 5/2018 Copper ..... H01R 13/113
2013/0023137 A1 * 1/2013 Glick ..... H01R 13/426 439/246

(Continued)

FOREIGN PATENT DOCUMENTS

DE 102012100166 A1 7/2013
JP 2003-059612 A 2/2003

*Primary Examiner* — Harshad C Patel
(74) *Attorney, Agent, or Firm* — Sughrue Mion, PLLC

(57) ABSTRACT

A connector is provided that is easy to assemble. A terminal fitting is arranged on a base of a housing, a conductor portion is inserted into a tubular portion of a conductor connection portion, and a lid portion is assembled on the base. Thus, an insertion portion is inserted between extension portions to that intersect each other, and a diameter of the tubular portion is reduced. The conductor portion is tightened by the tubular portion, and the conductor connection portion is connected to the conductor portion. Therefore, a dedicated machine is not required to connect the terminal fitting to an electric wire, and operation of connecting the terminal fitting to the electric wire and of accommodating the terminal fitting in the housing can be performed substantially simultaneously. Thus, the connector can be easily assembled.

10 Claims, 6 Drawing Sheets

(56) References Cited

U.S. PATENT DOCUMENTS

| | | | | |
|---|---|---|---|---|
| 2018/0212340 | A1* | 7/2018 | Bhagyanathan-Sathlanathan ..... | H01R 13/432 |
| 2018/0331454 | A1* | 11/2018 | Hirota ..... | H01R 13/434 |

* cited by examiner

CONNECTOR COMPRISING A TRMINAL FITTING HAVING INTERSECTING EXTENSION PORTIONS

BACKGROUND OF THE INVENTION

Field of the Invention

The present invention relates to a connector.

Description of the Related Art

Generally, there is known a connector formed by crimping a terminal fitting to an end of an electric wire and accommodating the terminal fitting in a housing. As a terminal crimping machine for crimping terminal fitting when manufacturing such a connector, there has been proposed a terminal crimping machine in which a surplus portion of a wire crimping piece does not bulge outward in a width direction (for example, see Patent Literature 1). By using the terminal crimping machine described in Patent Literature 1 and preventing the surplus portion of the wire crimping piece from bulging outward in the width direction, when the terminal fitting is accommodated in the housing, the surplus portion is suppressed from being caught.

CITATION LIST

Patent Literature

Patent Literature 1: JP-A-2003-59612

SUMMARY OF THE INVENTION

However, if a terminal fitting is crimped to an electric wire using a terminal crimping machine as described in Patent Literature 1, a dedicated terminal crimping machine is required. Further, a step of accommodating the terminal fitting in the housing after crimping the terminal fitting to the electric wire is required. Therefore, it has been desired to easily assemble the connector.

An object of the present invention is to provide a connector that can be easily assembled.

A connector of the present invention includes an electric wire with a conductor exposed at a tip thereof, a terminal fitting having a terminal connection portion to be connected to a mating terminal and a conductor connection portion in which a tubular portion into which the conductor portion can be inserted is formed by projecting extension portions that intersect each other from both end edges of a gutter-like portion; and a housing including a first portion, and a second portion having an insertion portion and accommodating the terminal fitting, wherein the second portion is assembled to the first portion and the insertion portion is inserted between the extension portions, so that a diameter of the tubular portion is reduced.

According to such a connector of the present invention, by inserting the conductor into the tubular portion, arranging the terminal fitting on the first portion of the housing and assembling the second portion, the tubular portion is reduced in diameter. Thereby, the conductor portion is tightened by the tubular portion, and the conductor connection portion is connected to the conductor portion. Therefore, a dedicated machine is not required to connect the terminal fitting to the electric wire, and operation of connecting the terminal fitting to the electric wire and of accommodating the terminal fitting in the housing can be performed substantially simultaneously, and the connector can be easily assembled.

DETAILED DESCRIPTION OF THE PREFERRED EMBODIMENTS

Figure 1:
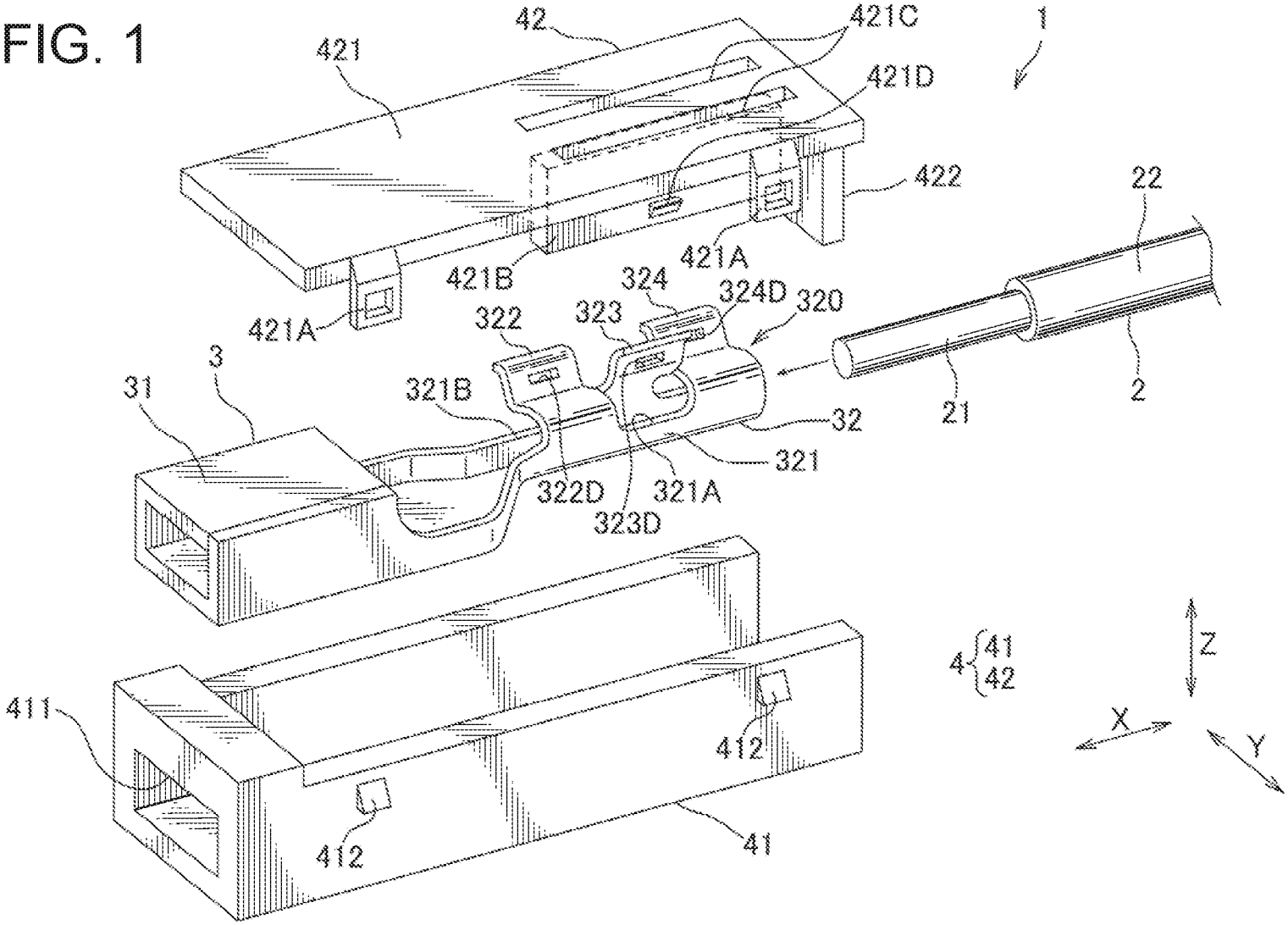
FIG. 1 is a perspective view showing a connector according to an embodiment of the present invention.

Hereinafter, embodiments of the present invention will be described with reference to the drawings. As shown in FIG. 1, a connector 1 of the present embodiment is a female connector including an electric wire 2, a terminal fitting 3, and a housing 4, and is configured to be able to be fitted with a mating male connector. In this embodiment, an axial direction of the electric wire 2 is defined as an X direction, and two directions orthogonal to the X direction are defined as a Y direction and a Z direction.

The electric wire 2 has a conductor portion 21 and an insulating coating portion 22 provided around the conductor portion 21. The insulating coating portion 22 is removed from a tip of the electric wire 2, and the conductor 21 is exposed. Note that the conductor portion 21 may be formed of an appropriate metal member such as copper or aluminum, and may be configured by twisting a plurality of fine wires or may be configured by a single conductor.

The terminal fitting 3 is formed by bending a single sheet metal member, and integrally has a terminal connection portion 31 connected to the mating terminal and a conductor connection portion 32 connected to the conductor portion 21.

The terminal fitting connecting portion 31 is formed in a square tubular shape to constitute a female terminal portion, and is connected to a male terminal fitting which is the mating terminal. Note that the terminal connection portion is not limited to such a shape, and may be configured to form a male terminal portion and be connected to a female terminal which is a mating terminal.

The conductor connection portion 32 has a gutter-like portion 321 formed in an arc shape when viewed from the X direction, and three extension portions 322 to 324 protruding from both end edges 321A and 321B of the gutter-like portion 321. Two extension portions 322 and 324 protrude from one end edge 321A in the Y direction, and one extension portion 323 protrudes from the other end edge 321B. In the X direction, the extension portions 322, the extension portion 323 and extension portion 324 are arranged in this order from the terminal connection portion 31 side.

On the upper surface of the bottom surface of the gutter-like portion 321 opposed to the extension portions 322 to 324, an appropriately shaped uneven portion (serration) is formed in order to make good contact with the conductor portion 21.

Figure 5:
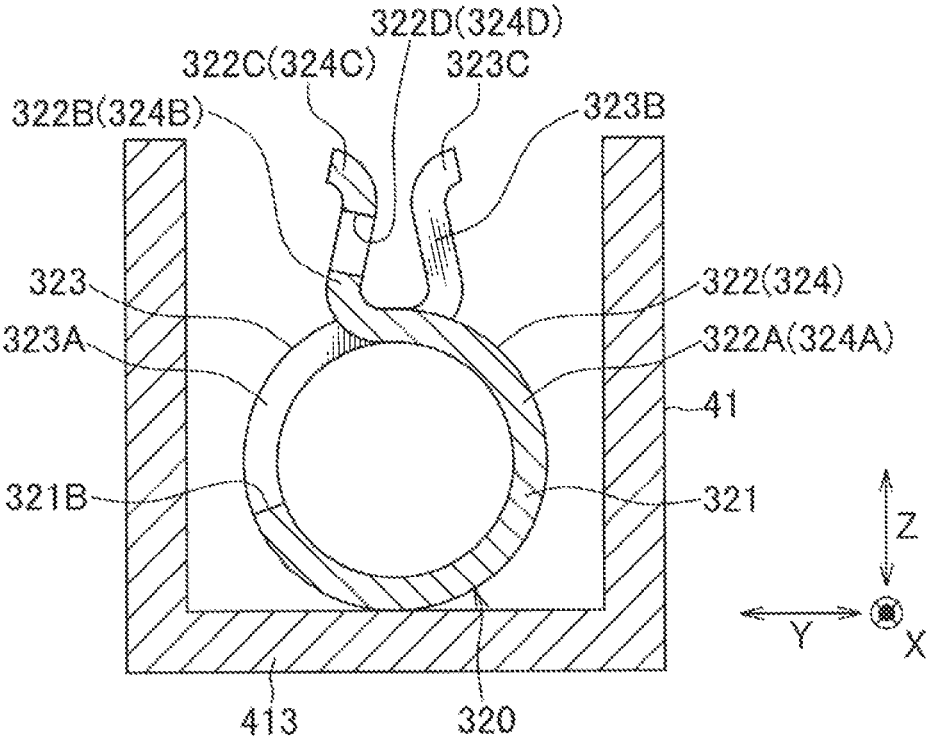
FIG. 5 is a cross-sectional view showing a state before the electric wire is inserted into the terminal fitting.

The extension portion 322 and the extension portion 323 intersect as viewed in the X direction, as shown in FIG. 5. That is, the tip of the extension portion 322 projecting from the one end edge 321A on the one side in the Y direction is disposed on the other side in the Y direction further than a tip of the extension portion 323 projecting from the end edge 321B on the other side in the Y direction. The extension portion 322 and the extension portion 324 have a shape that overlaps when viewed in the X direction, and the extension portion 324 also intersects with the extension portion 323.

The extension portions 322 to 324 are respectively provided with are portions 322A to 324A arranged on the same circumference as the arc of the gutter-like portion 321, inclined portions 322B to 324B which are bent from the arc portions 322A to 324A and extend radially outward, and separation extension portions 322C to 324C bent from the inclined portions 322B to 324B. Through holes-like locking holes 322D to 324D are formed in the inclined portions 322B to 324B. In the extension portions 322 to 324, the gutter-like portion 321 side is a base end side, and the opposite side is a tip end side. The gutter-like portion 321 and the arc portions 322A to 324A form a tubular portion 320 in the conductor connection portion 32 when viewed from the X direction.

In the natural state of the terminal fitting 3 as shown in FIG. 5, the inclined portion 322B of the extension portion 322, the inclined portion 324B of the extension portion 324, and the inclined portion 323B of the extension portion 323 are inclined with respect to the Z direction, and extend closer to each other in the Y direction toward the tip side.

The separation extension portions 322C to 324C are formed more distally than the inclined portions 322B to 324B, and the separation extension portion 322C of the extension portion 322 and the separation extension portion 324C of the extension portions 324 and the separation extension portion 323C of the extension portion 323 extend away from each other. In the natural state of the terminal fitting 3, it is preferable that opening dimension of the separation extension portions 322C to 324C in the Y direction at the uppermost position in the Z direction is larger than the width in the Y direction of an insertion portion 421B described later.

The housing 4 is formed in a box shape having a base 41 as a first portion and a lid portion 42 as a second portion, and accommodates the terminal fitting 3. The housing 4 is formed in a rectangular parallelepiped shape whose longitudinal direction is the X direction.

The base 41 has an opening on one side (upper side) in the Z direction, a connecting through-hole 411 through which a mating terminal passes on one side in the X direction, and opens on the opposite side in the X direction. In addition, locking projection 412 is formed on outer surface of the walls on both sides of the base 41 in the Y direction.

The lid portion 42 has a ceiling portion 421 for closing the opening of the base 41 in the Z direction and a standing wall 422 for closing the opening in the X direction, and is assembled to the base 41. The ceiling portion 421 has a lock arm 421A to be locked by the locking projection 412, so that the assembled state of the lid portion 42 is maintained to the base 41. The structure for assembling the base 41 and the lid portion 42 is not limited to this. For example, the assembled state may be maintained by pressing the lid portion into the base.

Figure 7:
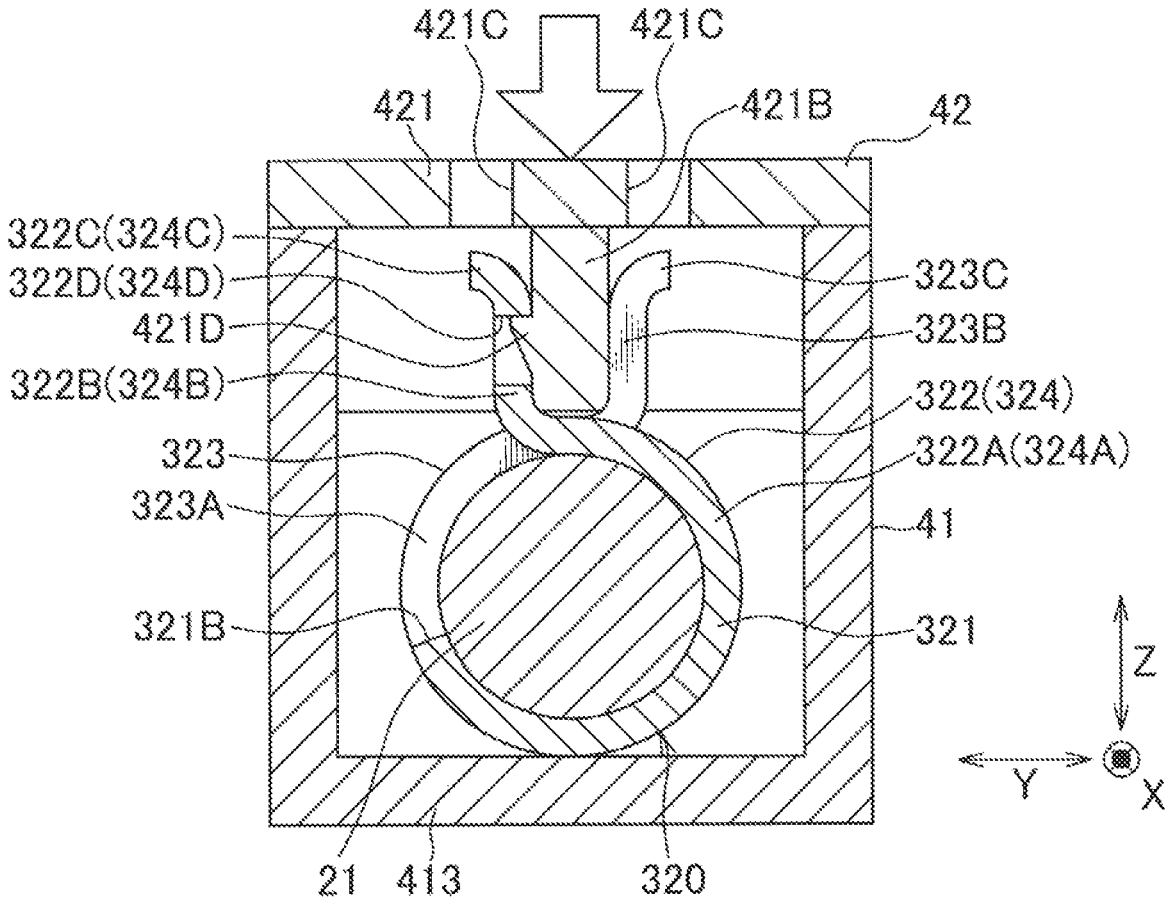
FIG. 7 is a cross-sectional view showing a state where the second portion is assembled to the first portion.

A plate-like insertion portion 421B extending along the ZX plane projects from the lower surface of the ceiling portion 421 as shown in FIG. 7. The insertion portion 421B may be formed at the center of the housing 4 in the Y direction, and may be formed at a position corresponding to the conductor connection portion 32 when the terminal fitting 3 is accommodated. A pair of jig insertion holes 421C is formed in the ceiling portion 421 at position sandwiching the insertion portion 421B from the Y direction. On both surfaces of the insertion portion 421B, locking projections 421D are formed at positions corresponding to the extension portions 322 to 324, respectively. That is, one locking projection 421D is formed on the right-side surface of the insertion portion 421B in FIG. 7 corresponding to the extension portion 323, and two locking projections 421D are formed on the left-side surface in correspondence with the extension portions 322 and 324, respectively.

Figure 2:
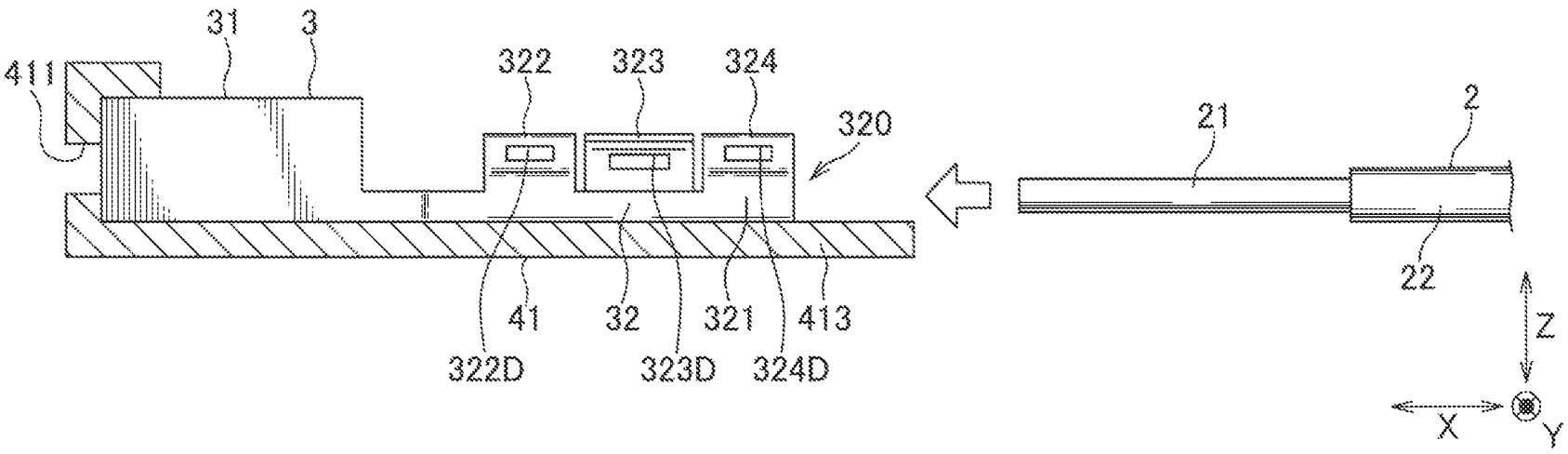
FIG. 2 is a cross-sectional view showing a state before an electric wire is inserted into a terminal fitting in the connector.
Figure 3:
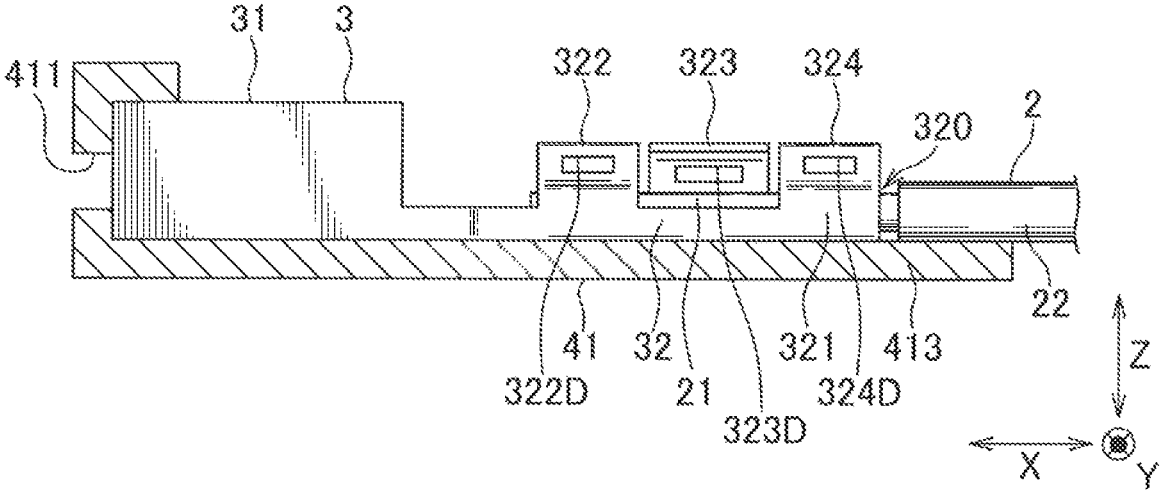
FIG. 3 is a cross-sectional view showing a state where the electric wire is inserted into the terminal fitting.
Figure 6:
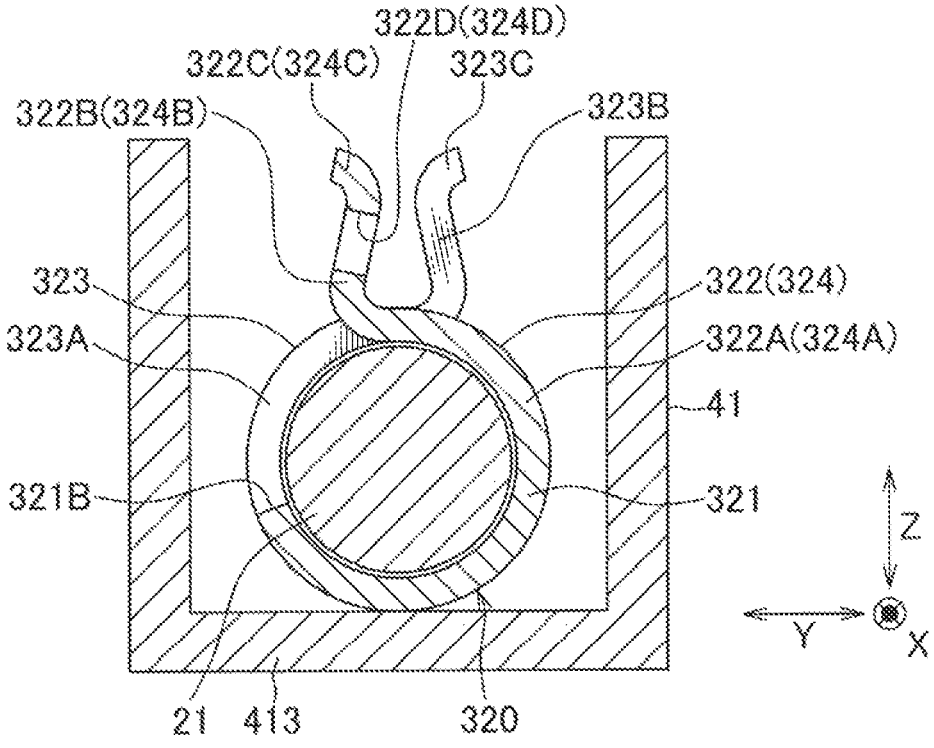
FIG. 6 is a cross-sectional view showing a state where the electric wire is inserted into the terminal fitting.

Here, a detailed procedure for assembling the connector 1 will be described with reference to FIGS. 2 to 7. First, as shown in FIGS. 2 and 5, the terminal fitting 3 is disposed on the bottom plate 413 of the base 41, and as shown in FIGS. 3 and 6, the conductor portion 21 of the electric wire 2 is inserted into the tubular portion 320 of the terminal fitting 3. At this time, the insulating coating portion 22 of the electric wire 2 is placed on the bottom plate 413. In the present embodiment, the inner diameter of the tubular portion 320 is larger than the outer diameter of the conductor portion 21, and the conductor portion 21 can be inserted without deforming the tubular portion 320. The inner diameter of the conductor 320 may be set to be equal to or less than the outer diameter of the conductor portion 21, and the worker may insert the conductor portion 21 while expanding the tubular portion 320.

Figure 4:
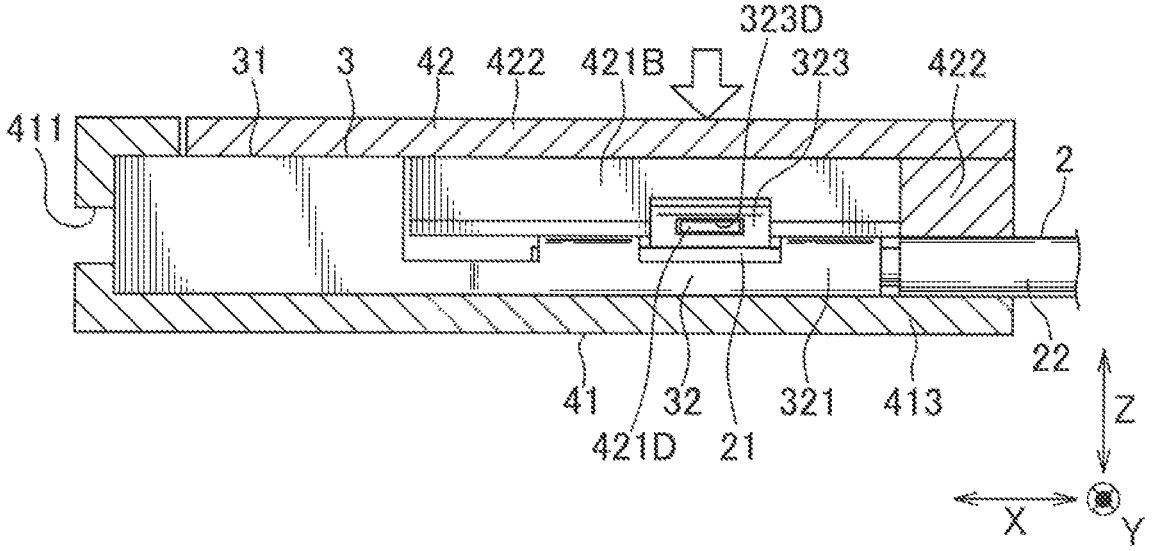
FIG. 4 is a cross-sectional view showing how a second portion is assembled to a first portion in the connector.

Next, as shown in FIGS. 4 and 7, the lid portion 42 is attached to the base 41 by approaching from above in the Z direction. At this time, the insertion portion 421B is inserted between the extension portions 322, 324 and the extension portion 323 that cross each other in the Z direction. The separation extension portions 322C to 324C are formed at the tips of the extension portions 322 to 324, so that the insertion portion 421B is guided to be inserted.

By inserting the insertion portion 421B, the conductor connection portion 32 is deformed so that the tips of the extension portions 322 and 324 and the tip portion of the extension portion 323 move away from each other. Thereby, the diameter of the tubular portion 320 is reduced (that is, the inner diameter is reduced), and the conductor portion 21 is tightened.

When the lid portion 42 is completely assembled to the base 41 (when the lock arm 421A is locked to the locking projection 412), the inclined portions 322B to 324B of the extension portions 322 to 324 follow along the side surface of the insertion portion 421B and extend in the Z direction. That is, the inclined portions 322B and 324B and the inclined portion 323B extend so as to approach to each other in the natural state are deformed so as to be substantially parallel to each other. At this time, the locking projections 421D formed on the insertion portion 421B engage with the locking holes 322D to 324D formed on the extension portions 322 to 324, respectively. That is, the lid portion 42 has the locking projection 421D as a locking portion for locking the extension portions 322 to 324.

The tubular portion 320 may be deformed to an extent capable of holding the conductor portion 21. That is, the diameter of the conductor 21 may be reduced to such a degree that the conductor 21 does not fall out of the tubular portion 320 in accordance with the usage environment of the connector 1 or the like. At this time, the conductor portion 21 may be slightly deformed, but it is preferable that when the terminal fitting 3 is detached from the conductor portion 21, the electric wire 2 be deformed to such an extent that the electric wire 2 can be reused.

Also, when the lid portion 42 is completely assembled to the base 41, the insulating coating portion 22 of the electric wire 2 is sandwiched between the bottom plate 413 of the base 41 and the lower end of the standing wall 422 of the cover 42, and the insulating covering portion 22 is held by the housing 4.

Figure 8:
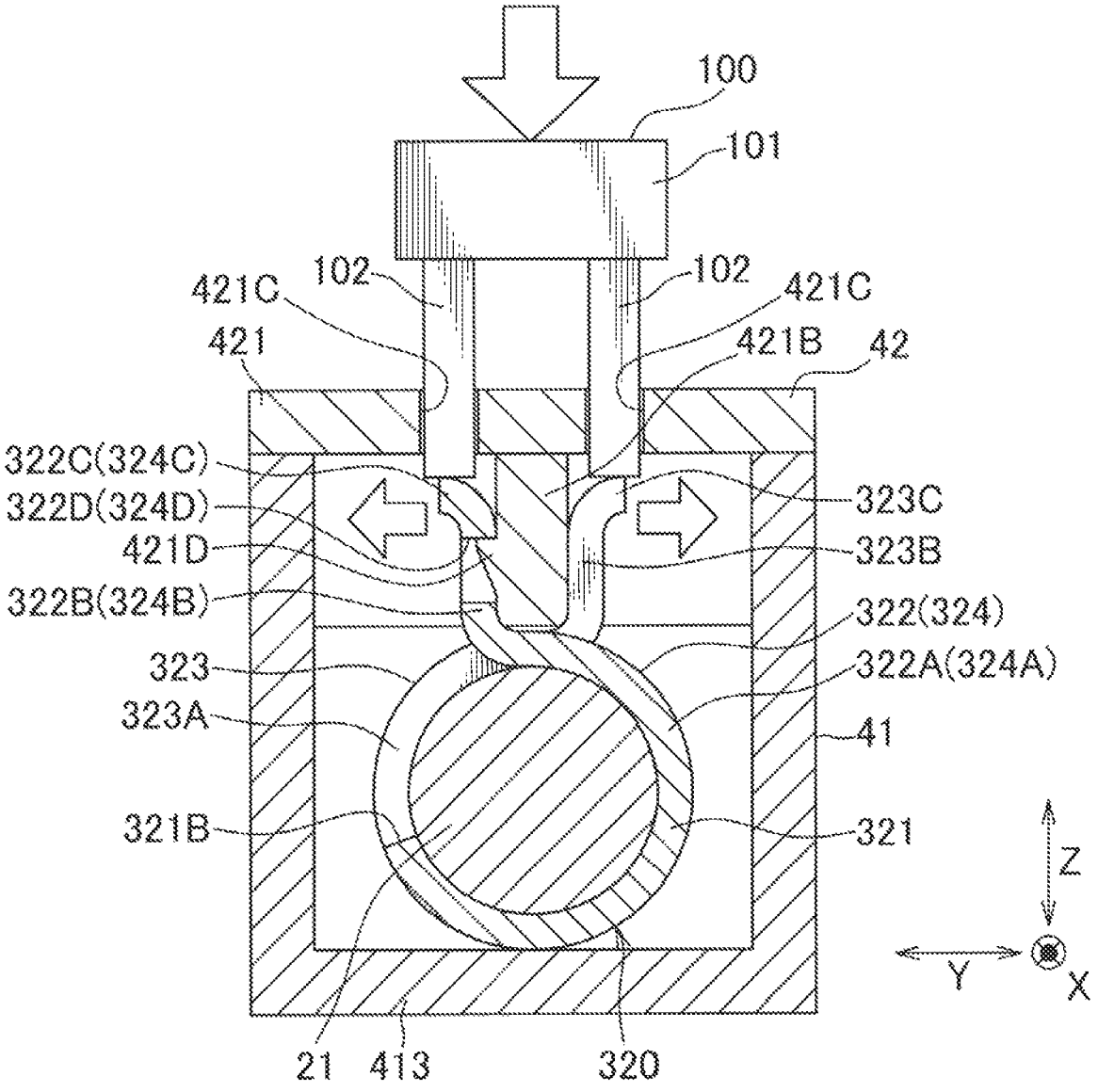
FIG. 8 is a cross-sectional view showing a state in which the second portion is removed from the first portion.

When removing the lid portion 42 from the base 41, a jig 100 as shown in FIG. 8 may be used. The jig 100 has a base 101 and a pair of protrusions 102 protruding from the base 101, and each of the pair of protrusions 102 can be inserted into a pair of jig insertion holes 421C of the ceiling portion 421.

When the protrusions 102 are inserted into the jig insertion holes 421C, the protrusions 102 come into contact with the separation extension portions 322C to 324C of the extension portions 322 to 324, and thereby the tips of the extension portions 322 and 324 and the tip of the portion 323 move away from each other. As a result, the locking projection 421D is disengaged from the locking holes 322D to 324D and unlocked, and the lid portion 42 can be removed from the terminal fitting 3. In such a state, the lid portion 42 can be removed from the base 41 by removing the lock arm 421A of the lid portion 42 from the locking projection 412 of the base 41 to be unlocked.

According to the present embodiment, the following effects can be obtained. That is, by disposing the terminal fitting 3 on the base 41 of the housing 4, inserting the conductor portion 21 into the tubular portion 320 of the conductor connection portion 32, and attaching the lid portion 42 to the base 41, the tubular portion 320 is contracted in diameter. Thus, the conductor portion 21 is tightened by the tubular portion 320, and the conductor connection portion 32 is connected to the conductor portion 21. Therefore, a dedicated machine is not required to connect the terminal fitting 3 to the electric wire 2, and the operation of connecting the terminal fitting 3 to the electric wire 2 and the operation of accommodating the terminal fitting 3 in the housing 4 can be performed substantially simultaneously. Thus, the connector 1 can be easily assembled.

Further, by connecting to the conductor portion 21 by tightening the tubular portion 320, the lid portion 42 can be removed from the base 41 to loosen the fastening of the tubular portion 320, and the terminal fitting 3 can be removed from the electric wire 2. Therefore, as compared with the configuration in which the terminal fitting is crimped, each component can be easily reused after the connector 1 is disassembled.

Further, by sandwiching and holding the insulating coating portion 22 of the electric wire 2 by the base 41 and the lid portion 42, the deformation of the electric wire 2 such that the insulating coating portion 22 rubs against the housing 4 is suppressed, and the insulating coating portion 22 can be suppressed to be damaged.

In addition, since the extension portions 322, 324 and the extension portion 323 which cross each other have the inclined portions 322B, 324B and the inclined portion 323B which approach each other toward the tip side, respectively, the extension portions 322 to 324 are easily deformed, and the diameter of the tubular portion 320 is easily reduced by inserting the insertion portion 421B between the inclined portions 322B, 324B and the inclined portion 323B.

In addition, the extension portions 322, 324 and the extension portion 323 that intersect each other have the separation extension portions 322C, 324C and the separation extension portion 323C that extend away from each other, so that the insertion portion 421B can be easily inserted between the extension portions 322, 324 and the extension portion 323.

Further, since the lid portion 42 has the locking projection 421D for locking the extension portions 322 to 324, it is possible to prevent the fastening of the tubular portion 320 from being unintentionally loosened. The portion 21 can be stably held by the tubular portion 320.

Note that the present invention is not limited to the above-described embodiment, but includes other configurations and the like that can achieve the object of the present invention, and includes the following modifications and the like.

For example, in the above-described embodiment, the extension portions 322 to 324 have the inclined portions 322B to 324B approaching each other and the separation extension portions 322C to 324C moving away from each other, but may be configured to be inserted between the intersecting extension portions, and the inclined portion and the separation extension portion need not be formed. For example, the insertion portion may have a tapered shape (wedge shape), and may be configured to be easily inserted between the intersecting extension portions.

Further, in the above-described embodiment, the insulating coating portion 22 of the electric wire 2 is sandwiched and held by the base 41 and the lid portion 42, but is not limited to such a configuration. That is, the insulating coating portion may be held only by one of the base and the lid portion, or the insulating coating portion may be held by the terminal fitting like the conductor portion. Further, the configuration may be such that the insulating coating portion is not held.

In addition, in the above-described embodiment, the lid portion 42 is assembled close to the base 41 in the Z direction. However, the assembly direction in the housing 4 is not limited to the Z direction. For example, a configuration may be adopted in which the lid portion is slid in the X direction (axial direction of the electric wire) with respect to the base and assembled. At this time, it is preferable that the insertion portion has a wedge shape so that the insertion portion can be easily inserted from the X direction between the extension portions that intersect each other. Alternatively, a configuration may be adopted in which a portion of the lid portion is integrally formed by being pivotally supported by the base, and is assembled (locked) to the base by rotating the lid portion.

In the above-described embodiment, the lid portion 42 has the locking projections 421D for locking the extension portions 322 to 324. However, a locking hole or a locking recess is formed in the extension portion, and the locking protrusion may be formed in the extension portion. Further, when the conductor can be stably held by the tubular portion, the locking portion may be omitted.

Although the best configuration and method for carrying out the present invention have been disclosed in the above description, the present invention is not limited to this. That is, although the present invention has been specifically shown and described with reference to specified embodiments, it will be understood that other modifications may be made without departing from the spirit and scope of the invention. Those skilled in the art can make various modifications in terms of material, quantity, and other detailed configurations. Therefore, since the description of the shapes, materials, and the like disclosed above is merely illustrative for the purpose of facilitating understanding of the present invention, and does not limit the present invention, the description by the name of the member excluding some or all of the limitations such as shapes and materials is included in the present invention.

REFERENCE SIGNS LIST

1 connector
2 electric wire
21 conductor
22 insulation coating portion
3 terminal fitting
31 terminal connection portion
32 conductor connection portion
321 gutter-like portion
322-324 extension portion
320 tubular portion
322B-324B inclined portion
322C-324C separation extension portion
4 housing
41 base (first portion)
42 lid portion (second portion)
421B insertion portion
421D locking projection (locking portion)

What is claimed is:

1. A connector comprising:

an electric wire with a conductor portion exposed at a tip thereof, a terminal fitting having a terminal connection portion to be connected to a mating terminal and a conductor connection portion in which a tubular portion is formed into which the conductor portion can be inserted, by projecting extension portions intersecting each other from both end edges of a gutter-like portion; and a housing including a first portion, and a second portion having an insertion portion, and accommodating the terminal fitting, wherein by assembling the second portion to the first portion, the insertion portion is inserted between the extension portions, so that a diameter of the tubular portion is reduced.

2. The connector according to claim 1, wherein the housing sandwiches and holds an insulating coating portion of the electric wire between the first portion and the second portion.

3. The connector according to claim 2, wherein the extension portions that intersect each other have inclined portions that approach each other toward a tip side in a natural state of the terminal fitting.

4. The connector according to claim 3, wherein the extension portions that intersect each other have a separation extension portion that extends away from each other on a tip side of the inclined portions.

5. The connector according to claim 3, wherein the second portion has a locking portion for locking the extension portions.

6. The connector according to claim 2, wherein the second portion has a locking portion for locking the extension portions.

7. The connector according to claim 1, wherein the extension portions that intersect each other have inclined portions that approach each other toward a tip side in a natural state of the terminal fitting.

8. The connector according to claim 7, wherein the extension portions that intersect each other have a separation extension portion that extends away from each other on a tip side of the inclined portions.

9. The connector according to claim 7, wherein the second portion has a locking portion for locking the extension portions.

10. The connector according to claim 1, wherein the second portion has a locking portion for locking the extension portions.

* * * * *